US010378712B2

(12) United States Patent
Garcia Castilla et al.

(10) Patent No.: US 10,378,712 B2
(45) Date of Patent: Aug. 13, 2019

(54) HEATSINK FOR AN OPTICAL MODULE FOR A MOTOR VEHICLE

(71) Applicant: Valeo Iluminacion, Martos (ES)

(72) Inventors: José Garcia Castilla, Martos (ES); Vicente Vallejo Fernandez, Martos (ES)

(73) Assignee: Valeo Iluminacion, Martos (ES)

( * ) Notice: Subject to any disclaimer, the term of this patent is extended or adjusted under 35 U.S.C. 154(b) by 168 days.

(21) Appl. No.: 15/228,268

(22) Filed: Aug. 4, 2016

(65) Prior Publication Data

US 2017/0045194 A1 Feb. 16, 2017

(30) Foreign Application Priority Data

Aug. 6, 2015 (FR) ..... 15 57586

(51) Int. Cl.

| | |
|---|---|
| ***F21S 41/19*** | (2018.01) |
| ***F21S 41/36*** | (2018.01) |
| ***F21S 45/47*** | (2018.01) |
| ***F21S 45/49*** | (2018.01) |
| ***F21S 41/147*** | (2018.01) |
| ***F21S 41/365*** | (2018.01) |

(52) U.S. Cl.

CPC ..... *F21S 41/19* (2018.01); *F21S 41/147* (2018.01); *F21S 45/47* (2018.01); *F21S 45/49* (2018.01); *F21S 41/36* (2018.01); *F21S 41/365* (2018.01)

(58) Field of Classification Search

CPC ..... F21S 48/328; F21S 48/321

See application file for complete search history.

(56) References Cited

U.S. PATENT DOCUMENTS

| | | | | |
|---|---|---|---|---|
| 2006/0002125 | A1* | 1/2006 | Kim | F21K 9/00 362/509 |
| 2008/0144329 | A1* | 6/2008 | Okuda | B60Q 1/076 362/539 |
| 2014/0020882 | A1 | 1/2014 | Konishi et al. | |
| 2016/0009216 | A1* | 1/2016 | Song | F21V 19/00 362/516 |

FOREIGN PATENT DOCUMENTS

| | | | |
|---|---|---|---|
| CN | 201661961 | U | 12/2010 |
| JP | 2005217354 | A | 8/2005 |
| JP | 2012216538 | A | 11/2012 |
| KR | 101325197 | B1 | 11/2013 |
| KR | 101406214 | B1 | 6/2014 |

* cited by examiner

*Primary Examiner* — Andrew J Coughlin
*Assistant Examiner* — Zachary J Snyder
(74) *Attorney, Agent, or Firm* — Oblon, McClelland, Maier & Neustadt, L.L.P.

(57) ABSTRACT

A heatsink for an optical module for a motor vehicle (V), wherein the heatsink includes a bent plate, the plate includes a central part adapted to receive at least one light source of the optical module and including two edges common with two lateral parts, the two common edges forming bending axes of the plate; and the two lateral parts each forming an angle (β) with the central parts.

19 Claims, 4 Drawing Sheets

HEATSINK FOR AN OPTICAL MODULE FOR A MOTOR VEHICLE

CROSS-REFERENCE TO RELATED APPLICATIONS

This application claims priority to the French application 1557586 filed Aug. 6, 2015, which application is incorporated herein by reference and made a part hereof.

BACKGROUND OF THE INVENTION

1. Field of the Invention

The present invention concerns a heatsink for an optical module for a motor vehicle.

It finds one particular but nonlimiting application in lighting devices such as motor vehicle headlights.

2. Description of the Related Art

In a manner that is known to the person skilled in the art, a heatsink, notably for an optical module for a motor vehicle, is integrated into a lighting device. The lighting device includes a plurality of optical modules, each optical module including a reflector, a heatsink and one or more light sources.

The light sources are disposed on the heatsink facing the reflector of each optical module, the combination making it possible to produce a global light beam.

The heatsink is a casting. The heatsink includes dissipating fins to increase the heat exchange area. It therefore makes it possible to evacuate the heat produced by the light sources.

In this context, the present invention aims to propose another embodiment of a heatsink for an optical module for a motor vehicle.

SUMMARY OF THE INVENTION

To this end the invention proposes a heatsink for an optical module for a motor vehicle, wherein the heatsink includes a bent plate, the plate including:

- a central part adapted to receive at least one light source of the optical module and including two edges common with two lateral parts, the two common edges forming bending axes of the plate; and
- the two lateral parts each forming an angle with the central part.

In accordance with nonlimiting embodiments, the heatsink may further include one or more additional features from among the following:

In accordance with one nonlimiting embodiment, the angle is between 0° and 180° inclusive.

In accordance with one nonlimiting embodiment, the angle is equal to 90°.

In accordance with one nonlimiting embodiment, the plate is made of a thermally conductive material.

In accordance with one nonlimiting embodiment, the thermally conductive material is a metal.

In accordance with one nonlimiting embodiment, the plate is made of aluminum.

In accordance with one nonlimiting embodiment, the heatsink further includes a device for adjusting the optical module on a housing.

In accordance with one nonlimiting embodiment, the heatsink further includes a device for adjusting the optical module on a housing, the adjustment device includes at least three adjustment lugs.

In accordance with one nonlimiting embodiment, one end of a lateral part includes two adjustment lugs and one end of the other lateral part includes one adjustment lug.

In accordance with one nonlimiting embodiment, the adjustment device includes four adjustment lugs, and each end of a lateral part includes two adjustment lugs.

In accordance with one nonlimiting embodiment, the heatsink further includes at least one support tongue of an optical surface of the optical module.

In accordance with one nonlimiting embodiment, the support tongue is disposed at one end of the central part.

In accordance with one nonlimiting embodiment, the heatsink further includes means for centering an optical surface of the optical module.

In accordance with one nonlimiting embodiment, the heatsink further includes lugs for fixing the optical surface of the optical module disposed on respective opposite sides of the central part.

In accordance with one nonlimiting embodiment, the heatsink further includes orifices for centering a printed circuit card.

The centering orifices are orifices of poka yoke type.

In accordance with one nonlimiting embodiment, the optical surface is a reflector or a lens.

In accordance with one nonlimiting embodiment, the at least one light source is a light-emitting semiconductor chip.

In accordance with one nonlimiting embodiment, a light-emitting semiconductor chip is part of a light-emitting diode.

There is also proposed an optical module for a motor vehicle, wherein it includes:

- the heatsink;
- at least one optical surface adapted to be fixed to the heatsink and to cooperate with at least one light source; and
- the at least one light source adapted to be disposed on the heatsink.

In accordance with one nonlimiting embodiment, the optical module further includes a printed circuit card adapted to be mounted on the heatsink and to receive the at least one light source.

There is also proposed a lighting device for a motor vehicle, including a housing and at least one optical module having any one of the above features, the heatsink of the optical module being disposed on the housing.

In accordance with one nonlimiting embodiment, the lighting device includes a plurality of optical modules.

In accordance with one nonlimiting embodiment, the lighting device is a headlight.

There is also proposed a method of manufacturing a heatsink for an optical module for a motor vehicle, wherein it includes:

- cutting a sheet of a thermally conductive material to form a plate;
- bending the plate so as to form a central part and two lateral parts each forming an angle with the central part, the central part being adapted to receive at least one light source of the optical module.

In accordance with nonlimiting embodiments, the method of manufacture may further include one or more additional features from among the following:

In accordance with one nonlimiting embodiment, the thermally conductive material is a metal. In accordance with one nonlimiting embodiment, the thermally conductive material is aluminum.

In accordance with one nonlimiting embodiment, the method of manufacture further includes cutting and punching the plate to form a device for adjustment of the optical module on a housing.

In accordance with one nonlimiting embodiment, the adjustment device includes at least three adjustment lugs.

In accordance with one nonlimiting embodiment, the adjustment device includes four adjustment lugs.

In accordance with one nonlimiting embodiment, the method of manufacture further includes cutting and pressing the plate to form at least one support tongue of an optical surface of the optical module.

In accordance with one nonlimiting embodiment, the method of manufacture further includes punching the plate so as to form means for centering the optical surface of the optical module.

In accordance with one nonlimiting embodiment, the method of manufacture further includes cutting and punching the plate to form fixing lugs of the optical surface of the optical module.

In accordance with one nonlimiting embodiment, the method of manufacture further includes punching the plate so as to form orifices for centering a printed circuit card adapted to be mounted on the heatsink and to receive the at least one light source.

BRIEF DESCRIPTION OF THE ACCOMPANYING DRAWINGS

The invention and its various applications will be better understood on reading the following description and examining the accompanying figures.

DETAILED DESCRIPTION OF THE PREFERRED EMBODIMENTS

Elements identical by structure or by function appearing in different FIGS. retain the same references unless otherwise specified.

The heatsink 10 in accordance with the invention for an optical module 1 for a motor vehicle V is described with reference to FIGS. 1 to 6.

By motor vehicle is meant any type of motorized vehicle.

The optical module 1 (described later) shown in FIG. 1 includes the heatsink 10 and is integrated into a lighting device 3. In a nonlimiting example to which the remainder of the description refers, the lighting device 3 is a headlight. It will be noted that the motor vehicle V includes a righthand headlight and a lefthand headlight.

The heatsink 10 in accordance with the invention is described in detail hereinafter with reference to FIGS. 2 to 6.

Figure 2:
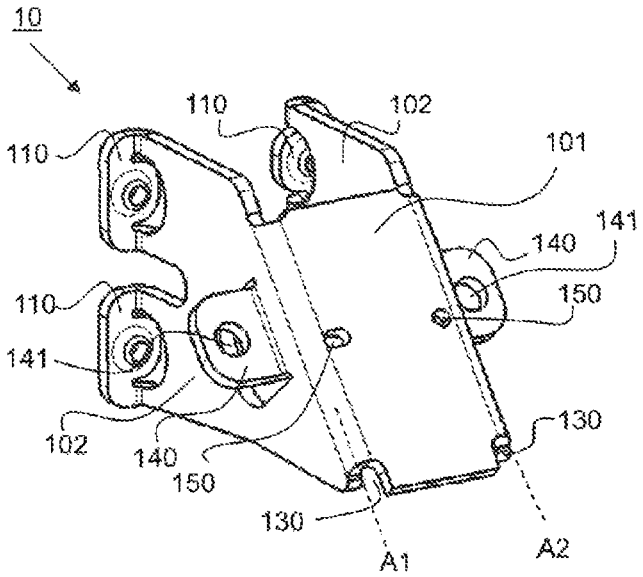
FIG. 2 represents a heatsink for the lighting device from FIG. 1 in accordance with one nonlimiting embodiment of the invention.
Figure 3:
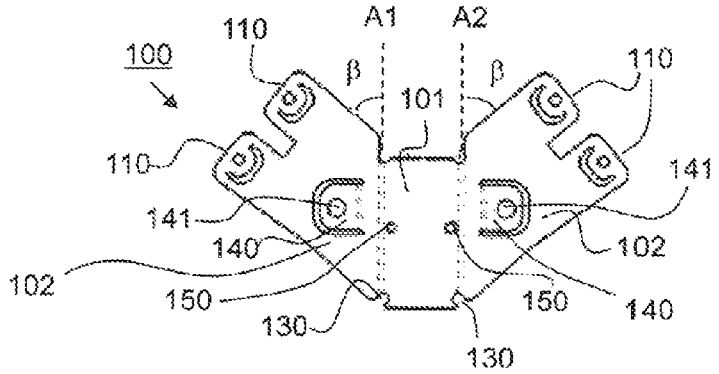
FIG. 3 represents the heatsink from FIG. 2 unbent.

As illustrated in FIGS. 2 and 3, the heatsink 10 includes a bent plate 100, the plate 100 including:

- a central part 101 adapted to receive at least one light source 13 of the optical module 1 and including two edges A1, A2 common with two lateral parts 102, the two common edges forming bending axes of the plate 100; and
- the two lateral parts 102 each forming an angle β with the central part 101. The angle β is referred to as the bending angle.

The edge A1 is common to the central part 101 and to one lateral part 102, the edge A2 is common to the central part 101 and to the other lateral part 102.

The angle β is represented in FIG. 3 which represents the heatsink 10 unbent.

In one nonlimiting embodiment, the angle β is between 0° and 180° inclusive. In one nonlimiting variant embodiment, the angle β is equal to 90°. Such an angle is easy to produce when the plate 100 is bent.

The fact that the plate 100 is bent makes it possible:

- to use a method of manufacture that is simple and of relatively low cost compared to a method of manufacture by casting;
- to obtain a lighter heatsink 10 and therefore a lighter lighting device 3; the weight reduction makes possible a reduction of the consumption of fuel used by the motor vehicle V;
- to obtain a better surface state than with a casting; it is therefore not necessary to remachine or to rework the plates, unlike a casting. It suffices merely to punch it. It is in fact necessary to have a good surface state for depositing afterwards a thermal adhesive or a thermal glue for gluing the printed circuit card 11 (described later) in particular. The fact of producing a better surface state makes it possible to apply less glue. Moreover, this also makes it possible to have an improved contact between the plate 100 and the printed circuit card 11 that is disposed on the plate 100 and consequently to obtain better exchange of heat between the two elements and therefore better evacuation of heat. The printed circuit card 11 in fact evacuates heat through contact with the plate 100.

In one nonlimiting embodiment, the plate 100 is made of a thermally conductive material. The material makes it possible to evacuate the heat produced by the light sources 13 and the printed circuit card 11 (described later).

The material is such that it can be transformed by a method of manufacture that includes cutting, bending and punching and, in one nonlimiting embodiment, pressing.

In one nonlimiting variant embodiment, the thermally conductive material is a metal.

In one nonlimiting embodiment of that variant embodiment, the material is aluminum. This material makes it possible to obtain good thermal conductivity, in one nonlimiting example from 120 watt per meter-kelvin ($W\ m^{-1} \cdot K^{-1}$), unlike a cast heatsink with dissipating fins that makes it possible to produce a thermal conductivity of only 90-120 $W \cdot m^{-1} \cdot K^{-1}$. The light sources 13 are therefore effectively cooled and their efficacy is therefore not degraded by heat.

Moreover, aluminum is a material that is light and easy to work. It is therefore possible to obtain up to 40% reduction of weight of the heatsink 10 compared to a cast heatsink.

In other nonlimiting embodiments, the material is copper or brass. These materials have even better thermal conductivity than aluminum but have a higher cost and a higher weight. With these materials other than aluminum, it is therefore possible to obtain between 10 and 20% weight reduction of the heatsink 10 compared to a cast heatsink.

Their thermal conductivity is in one nonlimiting example 420 $W \cdot m^{-1} \cdot K^{-1}$.

It will be noted that the heatsink 10 does not including dissipating fins. The bent plate 100 in fact includes an opening. This has the following advantages:

- the heatsink 10 is lighter;
- it makes it possible to have a large volume under the bent plate 100 for the circulation of air; less condensation is therefore produced;
- it improves the circulation of air, notably in the case of using a fan; and
- it is possible to have a connecting harness pass through the space left available under the bent plate 100.

The heatsink 10 makes it possible to receive at least a light source 13 and an optical surface 12, the assembly of the heatsink 10, the light source 13 and the optical surface 12 forming an optical module 1.

The light source 13 is either mounted directly on the heatsink 10 ("submount") or mounted on the heatsink 10 by means of the printed circuit card 11. In the latter case, in one nonlimiting embodiment, the heatsink 10 is adapted to receive the printed circuit card 11 on which the light source 13 is disposed. In this case, the optical module 1 is made up of the heatsink 10, the printed circuit card 11, the optical surface 12 and the light source 13.

In one nonlimiting embodiment, the optical surface 12 is a reflector. In another nonlimiting embodiment, the optical surface 12 is a lens. An optical surface 12 is therefore the surface responsible for reflecting the individual light beam emitted by the light source(s) 13.

The remainder of the description refers to the reflector by way of nonlimiting example.

As illustrated in FIGS. 2 to 6, in one nonlimiting embodiment, the heatsink 10 further includes an adjustment device 110 for adjustment of the optical module 1 on a housing 2 of the lighting device or headlight 3. The adjustment device 110 cooperates with a fixing system 210.

Figure 4:
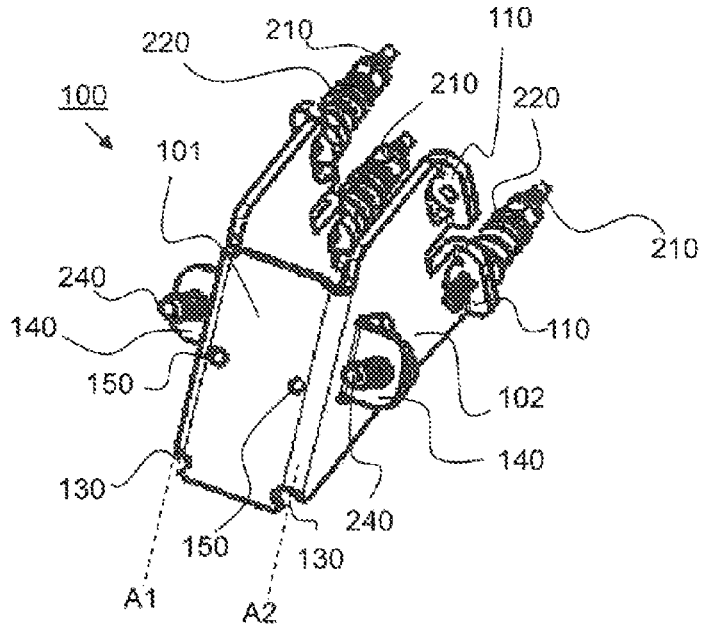
FIG. 4 represents the heatsink from FIG. 2 or 3 with a fixing system that cooperates with an adjustment device of the heatsink.

In one nonlimiting embodiment, the adjustment device 110 includes at least three adjustment lugs. As illustrated in FIG. 4, the adjustment device or adjustment lugs 110 make it possible to receive the fixing system or adjustment screws 210 each cooperating with a spring 220.

The springs 220 make it possible to retain the adjustment screws 210 and therefore to prevent them from being unscrewed.

The adjustment screws 210 make it possible to adjust the heatsink 10 and consequently the whole of the optical module 1 in a vertical direction and in a lateral direction. A first screw therefore serves as a fixed point, a second screw is used for the lateral adjustment, and the third screw serves for the vertical adjustment.

The various optical modules 1 of the headlight or lighting device 3 can therefore be adjusted relative to one another so that the global light beam produced by all of the light sources 13 when they cooperate with the optical surfaces or reflectors 12 is adjusted as a function of the required photometric function (described later). The individual light beam produced by the light source(s) 13 of each optical module 1 is therefore adjusted relative to the adjacent individual light beam(s).

In a first nonlimiting variant embodiment, the adjustment device 110 includes three adjustment lugs. One edge of one lateral part 102 of the plate 100 includes two adjustment lugs and one edge of the other lateral part 102 includes a single adjustment lug.

In this case, the adjustment device or three adjustment lugs 110 are disposed on the heatsink 10:

- in accordance with a first mode so as to produce a heatsink 10 referenced for the righthand headlight 3 of the motor vehicle V; two adjustment lugs 110 are disposed on a first lateral part 102 and one adjustment lug is disposed on the second lateral part 102;
- in accordance with a second mode so as to produce a heatsink 10 referenced for the lefthand headlight 3 of the motor vehicle V; in a mirrored arrangement with respect to the first mode, one adjustment lug 110 is disposed on the first lateral part 102 and two adjustment lugs 110 are disposed on the second lateral part 102.

The three adjustment screws 210 that cooperate with the three adjustment lugs 110 are therefore screwed in and out in accordance with two different adjustment modes as to obtain a heatsink 10 referenced for the righthand headlight 3 of the motor vehicle V and another heatsink 10 referenced for the lefthand headlight 3. There are therefore two different heatsink 10 references (and therefore two optical module 1 references) each adjusted in position for one of the two headlights 3 of the motor vehicle V.

In a second nonlimiting variant embodiment, the adjustment device 110 includes four adjustment lugs and each edge of a lateral part 102 of the plate 100 includes two adjustment lugs. In this case, the associated four adjustment screws 210 are screwed in and out in accordance with a single adjustment mode so as to obtain a heatsink 10 referenced for the righthand headlight 3 of the motor vehicle V and also for the lefthand headlight 3 of the motor vehicle V. The same heatsink 10 (and therefore a single optical module 1 reference) is therefore produced adjusted in position for both headlights 3 of the motor vehicle V.

It will be noted that in another nonlimiting variant embodiment the adjustment device 110 may include four adjustment lugs but only three adjustment screws. In this case, two heatsinks 10 (and therefore two optical module 1 references) are produced adjusted in position differently, one for each headlight 3 of the motor vehicle V, as in the first embodiment.

The printed circuit card 11, the at least one light source 13 and the reflector 12 are fixed to the heatsink 10 in the following manner.

In order to center the reflector 12 on the heatsink 10, in one nonlimiting embodiment, the heatsink 10 further includes means 130 for centering a reflector 12 of the optical module 1. The centering means 130 are disposed at one end of the central part 101 of the plate 100 and form two rounded notches. They therefore make it possible to center the reflector 12 on the heatsink 10 and also the printed circuit card 11. The light source or sources 13 disposed on the printed circuit card 11 are therefore centered relative to the reflector 12. It will be noted that the reflector 12 includes two locating pins 123 (illustrated in FIG. 1) which are therefore inserted in the two rounded notches for centering means 130.

In order to fix the reflector 12 to the heatsink 10, the heatsink 10 further includes fixing lugs 140 for fixing a reflector 12 of the optical module 1 disposed on respective opposite sides of the central part 101. In one nonlimiting embodiment, the fixing lugs 140 include two orifices 141 and are therefore adapted to receive two fixing screws 240 (illustrated in FIG. 4) that are inserted in the two orifices 141. It will be noted that the reflector 12 includes two hollow screwthreaded fixing cylinders 124 (illustrated in FIG. 1) into which the fixing screws 240 are screwed.

It will be noted that the fact of dissociating via different means the centering of the reflector 12 on the heatsink 10 and the fixing thereof thereto makes it possible to obtain a robust mechanical fixing unlike fixing means also serving as centering means.

In order to position the printed circuit card 11 on the heatsink 10, the heatsink 10 further includes orifices 150 for centering the printed circuit card 11 disposed on the central part 101. These centering orifices 150 are of the poka yoke type. These are polarizers that make it possible to position the printed circuit card 11 correctly on the heatsink 10.

Figure 5:
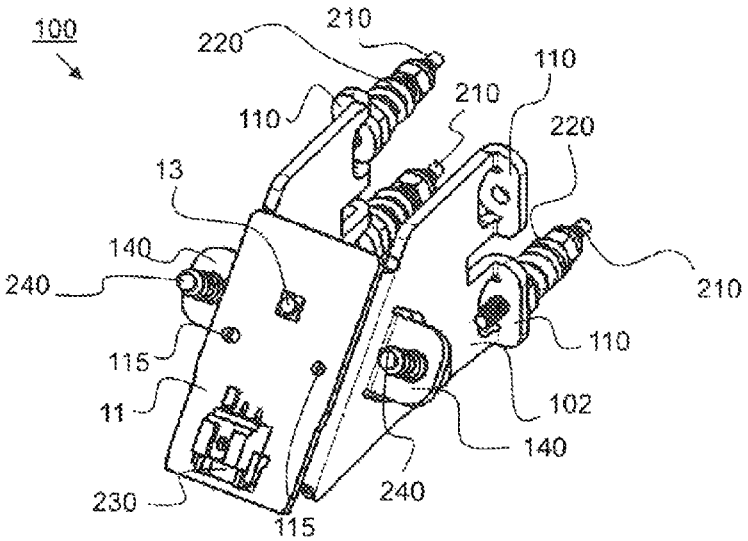
FIG. 5 represents the heatsink from FIGS. 2 to 4 with a printed circuit card on which a light source is disposed.
Figure 6:
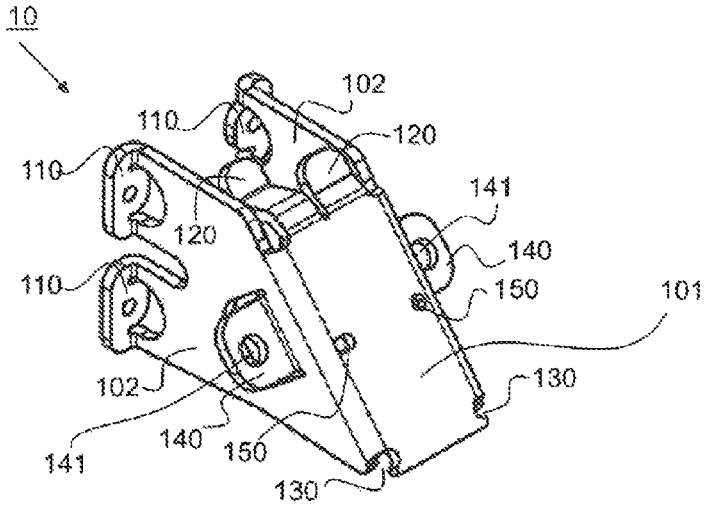
FIG. 6 represents the heatsink from FIGS. 2 to 5, the heatsink further including support tongues.

FIG. 5 illustrates the heatsink 10 with the printed circuit card 11. It will be noted that the latter includes centering orifices 115 corresponding to the centering orifices 150 of the heatsink 10. They are disposed facing the centering orifices 150 when the printed circuit card 11 is correctly positioned on the heatsink 10.

The centering orifices 115 and 150 are adapted to receive a centering pin (not illustrated) of the reflector 12. The reflector 12 is therefore also correctly centered on the printed circuit card 11. The printed circuit card 11 is therefore sandwiched between the heatsink 10 and the reflector 12 and is therefore no longer able to move because these centering pins cooperate with the centering orifices 115 and 150 and also because of the fixing of the reflector 12 to the heatsink 10 by means of the two fixing lugs 140.

The printed circuit card 11 further includes a connector 230 connected to a control and power supply unit (not illustrated) of the light sources 13.

In accordance with one nonlimiting embodiment, the heatsink 10 further includes at least one support tongue 120 for supporting a reflector 12 of the optical module 1. In the example illustrated in FIG. 6, the heatsink 10 includes two support tongues 120.

In one nonlimiting embodiment, the support tongue 120 is disposed at one end of the central part 101. In the example illustrated, the two support tongues 120 are disposed at the end opposite that on which the centering notches for centering means 130 are disposed.

In one nonlimiting embodiment, a support tongue 120 has an L-shape. It will be noted that the support tongue(s) 120 also have a polarizer function. Each support tongue 120 may therefore have a different slope for its L-shape, depending on the reflector 12 that the heatsink 10 is to receive. Each light beam produced by an optical module 1 will therefore be positioned relative to the other adjacent light beams from the adjacent optical modules 1 so as to obtain a global light beam suitable for the intended photometric function f1.

It will be noted that the reflector 12 includes to this end a rib (not illustrated) cooperating with each support tongue 120.

The invention also consists in an optical module 1 for a motor vehicle V. The optical module 1 is part of a lighting device 3 for the motor vehicle V, the lighting device 3 including a housing 2 and at least one optical module 1 described above. In one nonlimiting example, the lighting device 3 is a headlight.

Figure 1:
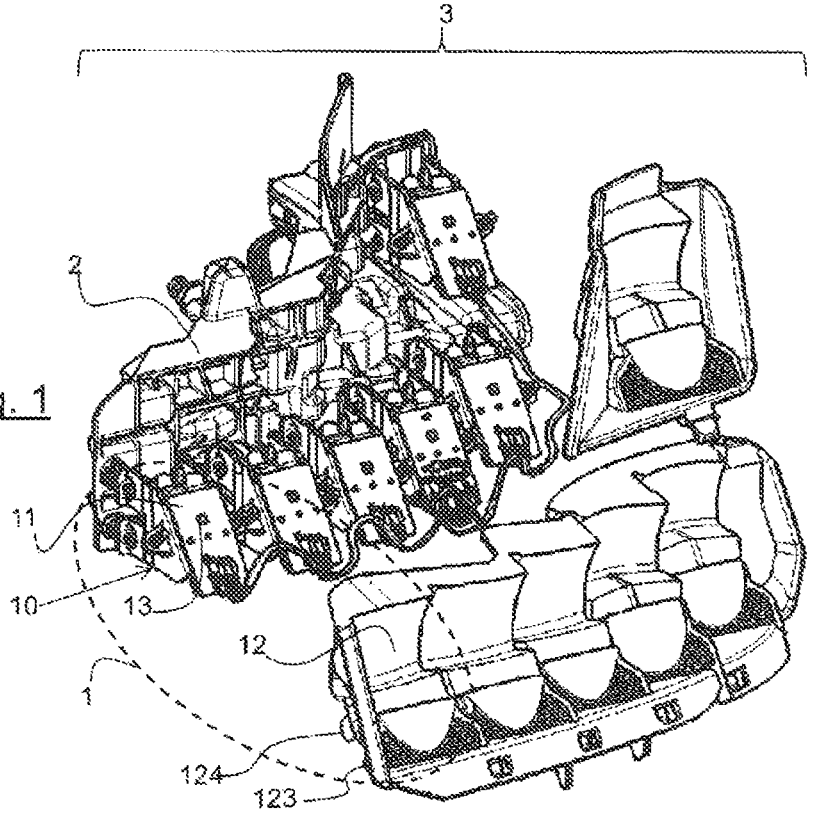
FIG. 1 represents an exploded view of a lighting device including a plurality of optical modules for a motor vehicle each including a heatsink in accordance with one nonlimiting embodiment of the invention.

In the example illustrated in FIG. 1, the lighting device or headlight 3 includes six optical modules 1.

The optical module 1 includes:

the heatsink 10 described above;

at least one optical surface 12 adapted to be fixed to the heatsink 10 and to cooperate with at least one light source 13; and at least one light source 13 adapted to be disposed on the heatsink 10.

The optical surface 12 represented in the nonlimiting example is a reflector.

In one nonlimiting embodiment as illustrated in FIG. 1, the optical module 1 includes a single light source 13 and a single reflector 12. A single light source 13 is therefore disposed on the heatsink 10 (either directly, or indirectly via the printed circuit card 11) and cooperates with the reflector 12 associated with the heatsink 10.

In one nonlimiting embodiment illustrated in FIG. 1 the optical module 1 further includes the printed circuit card 11 adapted to be mounted on the heatsink 10 and to receive at least one light source 13.

In one nonlimiting embodiment, the printed circuit card 11 is glued to the plate 100 or screwed to the plate 100 of the heatsink 10.

One or more light sources 13 is or are connected to a printed circuit card 11 also referred to as a PCB (Printed Circuit Board) card.

In a first nonlimiting embodiment, the light sources 13 are disposed on the printed circuit card 11.

In a second nonlimiting embodiment, the light sources 13 are fixed directly to the heatsink 10.

It will be noted that there may equally well be a combination of these two modes.

In one nonlimiting embodiment, the light sources 13 are light-emitting semiconductor chips.

In one nonlimiting variant embodiment, a light-emitting semiconductor chip is part of a light-emitting diode.

By light-emitting diode is meant any type of light-emitting diode whether this means, in nonlimiting examples, an LED (Light Emitting Diode), an OLED (organic LED), an AMOLED (Active-Matrix-Organic LED) or a FOLED (Flexible OLED).

The coupling of all of the light beams from the light sources 13 of the various optical modules 1 of the headlight 3 with the various reflectors 12 produces a global light beam adapted as a function of a required photometric function f1.

In one nonlimiting embodiment, the light beam has a cut-off.

In a first nonlimiting variant embodiment, the photometric function f1 is a so-called "low beam" function to produce a low beam. In this case, the light beam has a cutoff. It includes two segments one of which is horizontal and the other inclined. In accordance with the regulations in force, the inclined segment forms an angle of 15° relative to the horizontal segment. In one nonlimiting example three optical modules 1 will therefore be used to produce the segment inclined at 15°, namely to produce a so-called "kink" sub-function, and the other three optical modules 1 will be used to produce the horizontal segment, namely to produce a so-called "flat" sub-function.

The individual light beams produced by the light source(s) 13 of each of the first three optical modules 1 will be aligned with one another (by adjustment of the optical modules 1 by means of the adjustment device 110 as described above) so as to produce the segment inclined at 15°.

The individual light beams produced by the light source(s) 13 of each of the last three optical modules 1 will be aligned with one another (by adjustment of the optical modules 1 by means of the adjustment device 110 as described above) so as to produce the horizontal segment.

In a second nonlimiting variant embodiment, the photometric function f1 is a so-called "high beam" function to produce a high beam. In this case, the light beam does not have a cutoff.

In a third nonlimiting variant embodiment, the photometric function f1 is a so-called "fog" function to produce a fog beam. In this case, the light beam has a cutoff. It includes two segments one of which is horizontal and the other inclined.

In a fourth nonlimiting variant embodiment, the photometric function f1 is a DRL (Daytime Running Lamp) function to produce a daytime running lamp. In this case, the light beam does not have a cutoff.

The heatsink 10 for an optical module 1 for a motor vehicle V is produced by a method P of manufacture described hereinafter with reference to FIG. 7, the heatsink 10 including a bent plate 100.

Figure 7:
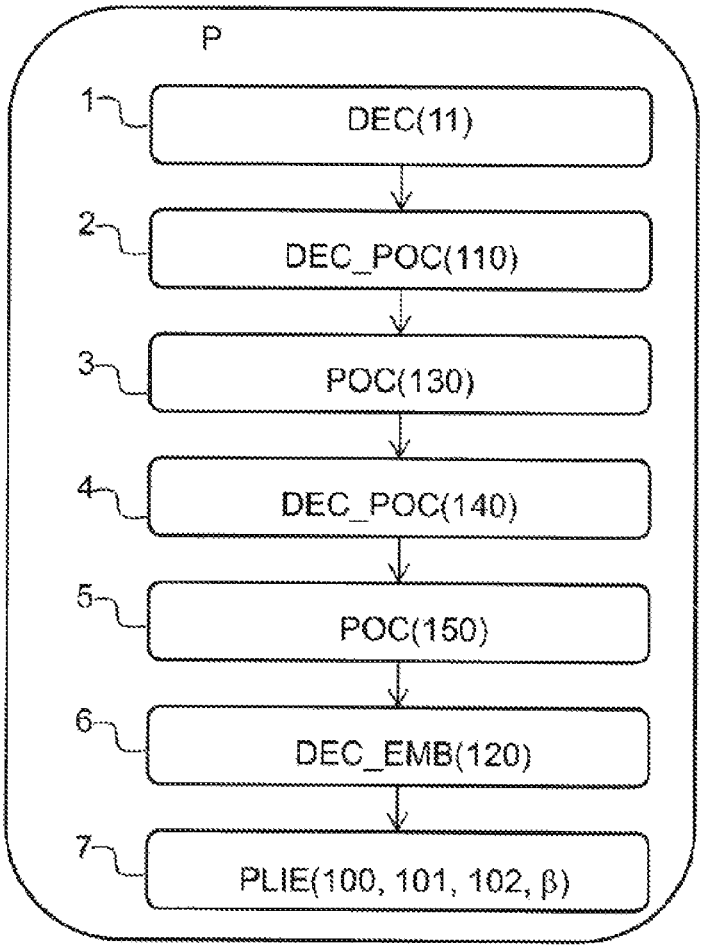
FIG. 7 is a flowchart of a method of manufacturing the heatsink from FIGS. 2 to 6 in accordance with one nonlimiting embodiment.

The method P of manufacture includes:

cutting a sheet of a thermally conductive material to form a plate 100 (function DEC(11) illustrated in FIG. 7);

bending the plate 100 so as to form a central part 101 and two lateral parts 102 each forming an angle β with the central part 101, the central part 101 being adapted to receive at least one light source 13 of the optical module 1 (PLIE(100, 101, 102, β) function illustrated in FIG. 7).

In one nonlimiting embodiment, the thermally conductive material is aluminum. The sheet is therefore a sheet of aluminum. It will be noted that the sheet of aluminum is produced by extrusion.

In order to form the adjustment device 110 of the optical module 1 on a housing 2 described above, in one nonlimiting embodiment, the method P of manufacture further includes cutting and punching the plate 100 (DEC_POC(110) function illustrated in FIG. 7).

In order to form the centering means 130 of the reflector 12 of the optical module 1 described above, in one nonlimiting embodiment, the method P of manufacture further includes punching the plate 100 (POC(130) function illustrated in FIG. 7).

In order to form fixing lugs 140 of the reflector 12 of the optical module 1 described above, in one nonlimiting embodiment, the method P of manufacture further includes cutting and punching the plate 100 (DEC_POC(140) function illustrated in FIG. 7).

In order to form the centering orifices 150 of the printed circuit card 11 described above, in one nonlimiting embodiment, the method P of manufacture further includes punching the plate 100 (POC(150) function illustrated in FIG. 7).

In order to form at least one support tongue 120 of a reflector 12 of the optical module 1 described above, in one nonlimiting embodiment, the method P of manufacture further includes cutting and pressing the plate 100 (DEC_EMB(120) function illustrated in FIG. 7).

It will be noted that all these operations may be carried out by means of tools in series or at separate workstations.

It will also be noted that the operations for forming the elements 110 to 150 of the heatsink 10 may be effected in any order.

The operation of cutting the aluminum sheet is for its part effected first while the operation of bending the plate 100 is for its part effected last.

Of course, the description of the invention is not limited to the embodiments described above.

Thus, in another nonlimiting embodiment, in the case where the global light beam produced by the optical modules 1 is totally horizontal, the adjustment device 110 may be fixed (it is not necessary to have associated adjustment screws 210) so that all the individual light beams are aligned with one another to form the horizontal global light beam.

Therefore, in another nonlimiting embodiment, the centering means 130 are not notches but centering lugs.

The invention described therefore has the following advantages in particular:

it makes it possible to reduce the weight of the heatsink 10 and therefore of the lighting device 3;

it makes it possible to increase the thermal efficiency for evacuating heat; the thermal conductivity of the heatsink 10 is higher;

it makes it possible no longer to use dissipating fins; the heatsink 10 therefore necessitates less heat exchange area (than with dissipating fins) for a higher thermal efficiency;

the heatsink 10 serves as a support for fixing the other components of the optical module 1, namely the light sources 13, the printed circuit card 11, the reflector 12;

the fact that the heatsink 10 comprises a bent plate 100 and not a casting facilitates the machining of the heatsink 10;

it makes it possible to obtain a lighter heatsink 10 with better thermal performance.

While the system, apparatus, process and method herein described constitute preferred embodiments of this invention, it is to be understood that the invention is not limited to this precise system, apparatus, process and method, and that changes may be made therein without departing from the scope of the invention which is defined in the appended claims.

What is claimed is:

1. A heatsink for an optical module for a motor vehicle (V), wherein the heatsink comprises a bent plate, said bent plate including:

a central part adapted to receive at least one light source of the optical module and including two edges common with two lateral parts, said two common edges forming bending axes of said bent plate, each of said two lateral parts including a pair of substantially parallel edges; and in an unbent state of the plate, said pair of substantially parallel edges of said two lateral parts each forming an angle with said respective common edge of said central part at which said respective lateral part is connected to said central part, wherein said angle is an acute angle.

2. The heatsink according to claim 1, wherein said bent plate is made of a thermally conductive material.

3. The heatsink according to claim 1, wherein said bent plate is made of aluminum.

4. The heatsink according to claim 1, wherein said heatsink further includes an adjustment device for adjustment of said optical module on a housing, said adjustment device including at least three adjustment lugs.

5. The heatsink according to claim 1, wherein said heatsink further includes means for centering an optical surface of said optical module.

6. The heatsink according to claim 5, wherein said optical surface is a reflector or a lens.

7. The heatsink according to claim 1, wherein said heatsink further includes fixing lugs for fixing an optical surface of said optical module disposed on respective opposite sides of said central part.

8. The heatsink according to claim 1, wherein said heatsink farther includes orifices for centering a printed circuit card.

9. An optical module for a motor vehicle (V), wherein it includes:

said heatsink according to claim 1;

at least one optical surface adapted to be fixed to said heatsink and to cooperate with said at least one light source; and said at least one light source adapted to be disposed on said heatsink.

10. The optical module according to claim 9, wherein said optical module further includes a printed circuit card adapted to be mounted on said heatsink and to receive said at least one light source.

11. The lighting device for a motor vehicle, including a housing and at least one of said optical module according to claim 9, said heatsink of said optical module being disposed on said housing.

12. The lighting device according to claim 11, wherein said lighting device is a headlight.

13. A method of manufacturing a heatsink for an optical module for a motor vehicle, wherein said method of manufacture includes:

cutting a sheet of a thermally conductive material to form a plate;

bending said plate so as to form a central part and two lateral parts each forming an angle with said central part, said central part being adapted to receive at least one light source of said optical module.

14. An optical module for a motor vehicle, wherein the optical module comprises:

a plate adapted to define a heatsink, said plate comprising;

a central part adapted to receive at least one light source of the optical module and including two edges common with two lateral parts, the two common edges forming bending axes of said plate, each of said two lateral parts including a pair of substantially parallel edges; and in an unbent state of the plate, said pair of substantially parallel edges of said two lateral parts each forming an angle with said respective common edge of said central part at which said respective lateral part is connected to said central part;

at least one optical surface adapted to be fixed to said heatsink and to cooperate with at least one light source; and said at least one light source adapted to be disposed on said heatsink, wherein said angle is an acute angle.

15. A lighting device for a motor vehicle, comprising;

a housing;

at least one optical module comprising a heatsink disposed on said housing, said heatsink comprising:

a central part adapted to receive at least one light source of the optical module and including two edges common with two lateral parts, the two common edges forming bending axes of said plate; and said two lateral parts each forming an angle with said central part; at least one optical surface adapted to be fixed to said heatsink and to cooperate with at least one light source; and said at least one light source adapted to be disposed on said heatsink, wherein each of said two lateral parts is substantially shaped as a right trapezoid.

16. The optical module according to claim 14, wherein said optical module further includes a printed circuit card adapted to be mounted on said heatsink and to receive said at least one light source.

17. The lighting device according to claim 15, said heatsink of said optical module being disposed on said housing.

18. The lighting device according to claim 15, wherein said at least one optical surface comprises a reflector and said lighting device is a headlight.

19. The lighting device according to claim 14, wherein a thermal conductivity of said plate is more than 420 $W \cdot m^{-1} \cdot K^{-1}$.

* * * * *